United States Patent [19]

Kageyama et al.

[11] Patent Number: 4,955,739

[45] Date of Patent: Sep. 11, 1990

[54] MECHANICAL PENCIL HAVING SIDE PUSH BUTTON ACTUATED LEAD ADVANCE

[75] Inventors: Hidehei Kageyama; Yoshihide Mitsuya; Youichi Nakazato, all of Kawagoe, Japan

[73] Assignee: Kotobuki & Co., Ltd., Kyoto, Japan

[21] Appl. No.: 261,244

[22] Filed: Oct. 21, 1988

[30] Foreign Application Priority Data

Oct. 23, 1987 [JP] Japan ..... 62-266630

[51] Int. Cl.[5] ..... B43K 21/16

[52] U.S. Cl. ..... 401/65; 401/85; 401/92

[58] Field of Search ..... 401/53, 65, 67, 92–94

[56] References Cited

U.S. PATENT DOCUMENTS

| | | | |
|---|---|---|---|
| 3,836,264 | 9/1974 | Saito et al. | 401/65 |
| 3,854,824 | 12/1974 | Kamo | 401/65 |
| 3,883,253 | 5/1975 | Naruse et al. | 401/65 |
| 4,149,813 | 4/1979 | Katz et al. | 401/65 |
| 4,504,163 | 3/1985 | Hashimoto et al. | 401/65 X |
| 4,521,126 | 6/1985 | Sakaoka et al. | 401/65 |

*Primary Examiner*—Richard J. Apley
*Assistant Examiner*—David F. Crosby
*Attorney, Agent, or Firm*—Sherman and Shalloway

[57] ABSTRACT

A mechanical pencil is disclosed in which lead can be advanced in one of two ways; either automatically upon release of writing pressure on the pencil, or selectively manually by pressing inwardly against a side push button. The pencil includes an outer cylinder with a side pushing hole formed therein, and a side push button movably disposed in the side pushing hole. The side push button contacts a lever which is totally mounted within the outer cylinder and which contacts a lead advanced mechanism. Upon pressing in of the side push button, the lever is pivoted about its axis and caused to press downwardly against the lead advance mechanism to thereby cause advancement of a lead. Advancement of lead is also performed upon release of writing pressure of the pencil by way of a slider mechanism which is biased outwardly by way of a resilient member and which is forced outwardly by the resilient member upon release of writing pressure. This causes the slider to pull a lead forwardly to provide advancement thereof.

4 Claims, 5 Drawing Sheets

MECHANICAL PENCIL HAVING SIDE PUSH BUTTON ACTUATED LEAD ADVANCE

BACKGROUND OF THE INVENTION

1. Field of the Invention

The present invention relates to a mechanical pencil whose lead can be moved down by side pushing. The present invention also relates to a mechanical pencil whose lead can be not only moved down by side pushing but also automatically moved down by the writing stoppage action of a slider away from the surface of paper or the like and in which the slider can be locked in a housed position inside the pencil when the pencil is not in use.

2. Description of the Prior Art

An automatic mechanical pencil, which can be pushed at the top thereof to move out a lead and includes a conventional one-way chuck, which holds the lead at the time of the action of writing pressure to the chuck and ceases the holding of the lead due to the resilient force of a slider and the action of a friction-causing portion fitted in the slider, at the time of the removal of the writing pressure from the chuck, to automatically move out the lead, has been recently proposed. However, since the mechanism of the automatic mechanical pencil is such that the slider cannot be completely put in by pushing the top of the pencil, the pencil has a problem that only the lower end of the slider projects out from the tip member of the pencil. Although the lead can be protruded from the lower end of the slider by pushing the lower end as the pencil remains held in a writing position, the pencil has another problem that the surface of paper or the like is contaminated by the lower end of the lead if the lower end of the slider is pushed on the paper or the like as the pencil remains held in the writing position.

A conventional mechanical pencil capable of moving out a lead by pushing the side of the pencil has problems that the constitution of the pencil is very complicated, and the holding of the outer cylinder of the pencil needs to be temporarily ceased to push the pencil at the side thereof, namely, the pencil cannot be manipulated to move out the lead as the pencil remains held in a writing position.

SUMMARY OF THE INVENTION

The present invention was made in order to solve the above-mentioned problems.

Accordingly, it is an object of the present invention to provide a mechanical pencil in which a tip pushing mechanism is provided for looking a slider in a completely housed position; and a lead can be protruded from the lower end of the slider by pushing the pencil at the side thereof as the pencil remains held in a writing position. In order to attain the object, a pushing member for enabling the pushing of the side of the mechanical pencil as the pencil remains held in the writing position, and a body ring fitted in the lower end of an inner sleeve to lock the slider in the completely housed position are provided. The mechanical pencil does not need to be pushed at the top thereof to move out the lead, but can be pushed at the side thereof by a fingertip, without re-holding the pencil, to easily move out the lead. Besides, the lead can be also automatically moved out by removing the pressure of writing due to the stoppage of the writing or to the like. In addition, the inner parts of the mechanical pencil can be assembled as a unit, and the number of all the parts of the pencil is reduced to facilitate the assembly of the pencil.

BRIEF DESCRIPTION OF THE DRAWINGS

FIG. 3(*b*) shows a sectional view of the middle cylinder along a line B—B shown in FIG. 2;

FIG. 3(*c*) shows a sectional view of the middle cylinder along a line C—C shown in FIG. 2;

FIG. 3(*d*) shows a sectional view of the middle cylinder along a line D—D shown in FIG. 2;

DETAILED DESCRIPTION OF THE PREFERRED EMBODIMENTS

An embodiment of the present invention is hereafter described in detail with reference to the drawings attached hereto.

Figure 1:
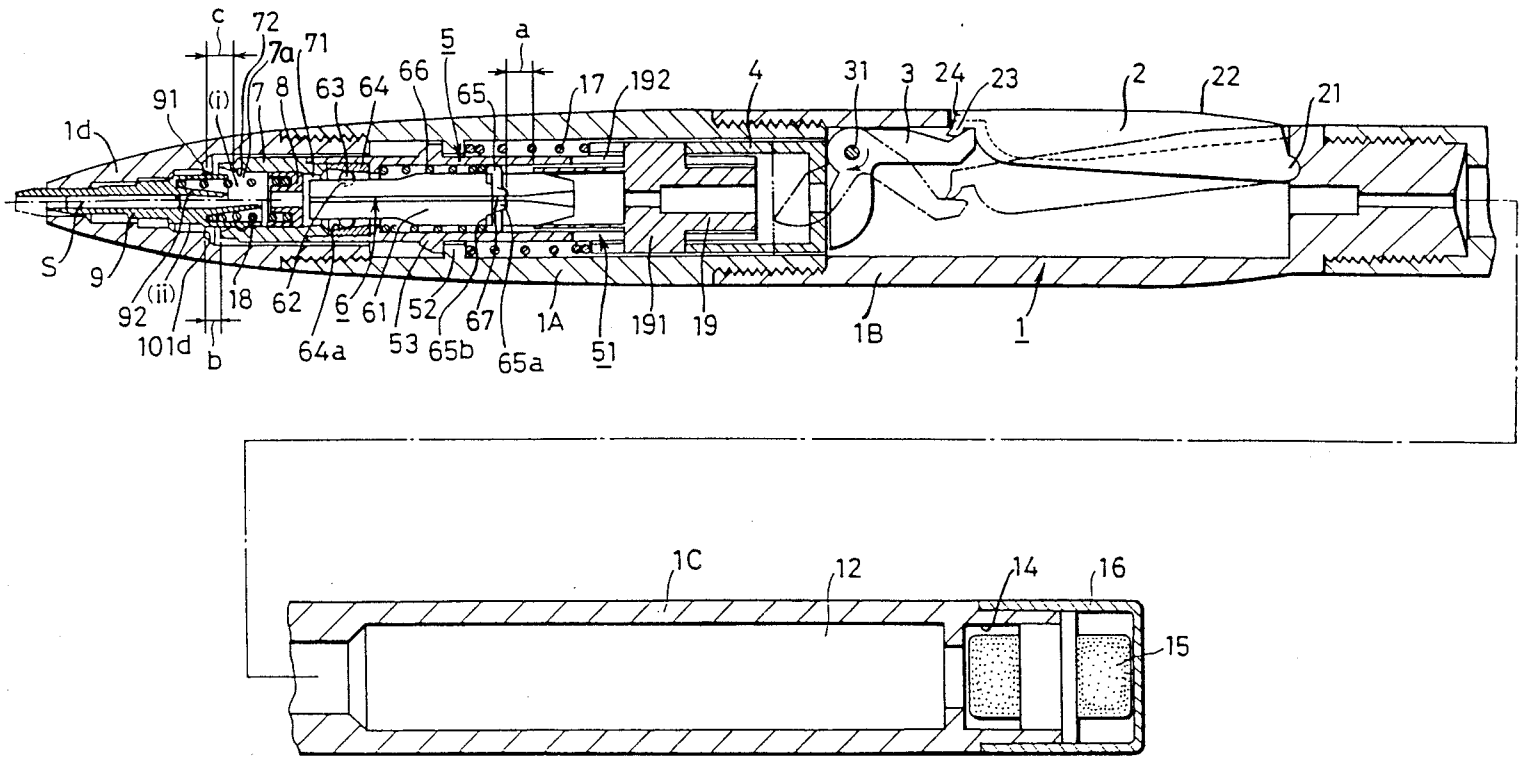
FIG. 1 shows a longitudinally sectional view of a mechanical pencil which is an embodiment of the present invention.

FIG. 1 shows an automatic mechanical pencil which is the embodiment. The pencil has an outer cylinder 1 comprising a lower cylinder 1A, a middle cylinder 1B and an upper cylinder 1C which are coupled to each other by fitting means so that the cylinders can be uncoupled from each other. A tip member 1D is removably fitted in the lower end of the lower cylinder 1A.

Figure 2:
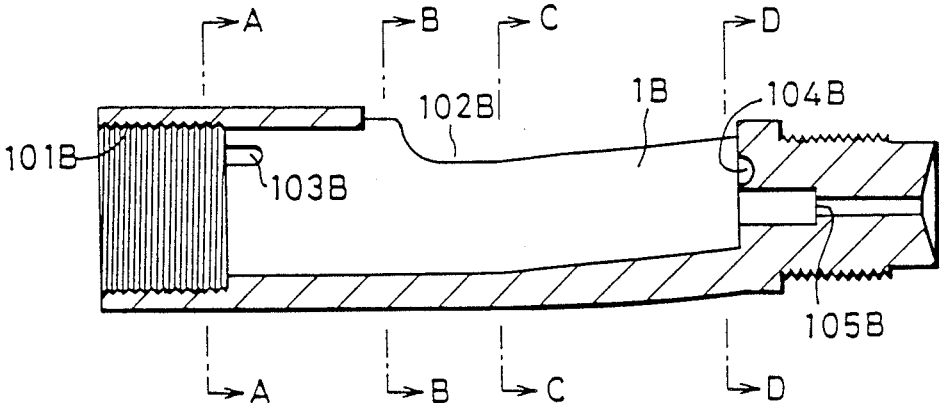
FIG. 2 shows a longitudinally sectional view of the middle cylinder of the mechanical pencil.
Figure 3:
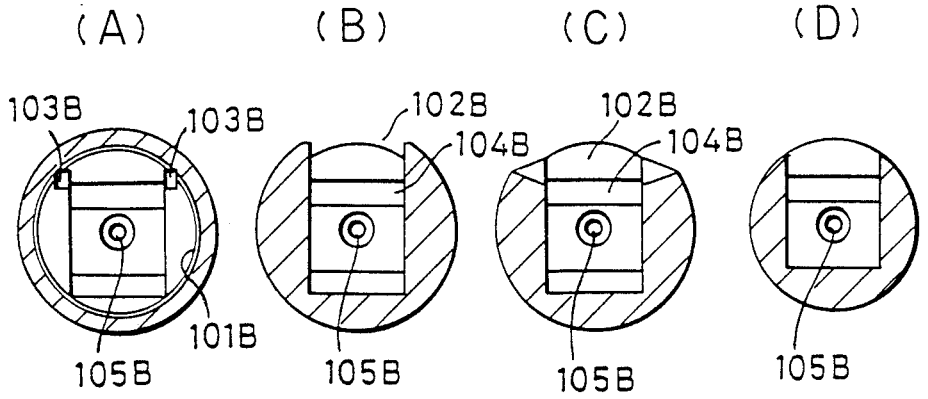
FIG. 3(*a*) shows a sectional view of the middle cylinder along a line A—A shown in FIG. 2.

As shown in FIG. 1, the middle cylinder 1B contains a pushing member 2 and a lever 3, which is turned by the pushing portion. As shown in FIGS. 2, 3(*a*), 3(*b*), 3(*c*) and 3(*d*), the middle cylinder 1B comprises a fitting portion 101B for the lower cylinder 1A, a side pushing hole 102B formed in the side of the middle cylinder, lever support grooves 103B in which a lever turning shaft 31 is rotatably engaged, a side pushing portion support groove 104B in which the turning portions 21 of the pushing member 2 are rotatably engaged, and a lead passage hole 105B. The side pushing hole 102B is formed as a slot in a side portion of the middle cylinder 1B. The manipulating projection 22 of the side pushing member 2 is located in the side pushing hole 102B so that the projection can be pushed by a fingertip when the outer cylinder 1 is held by a hand.

Figure 4:
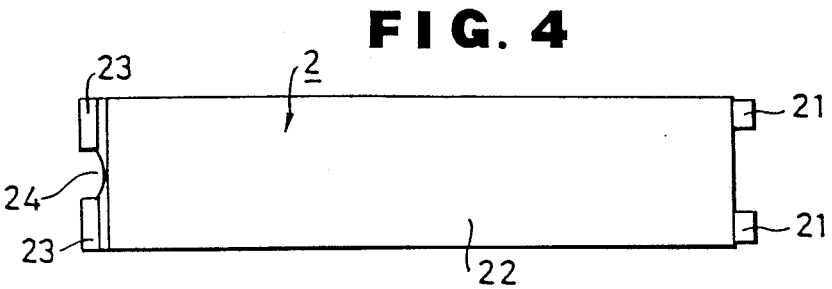
FIG. 4 shows a plan view of the pushing member of the mechanical pencil.
Figure 7:
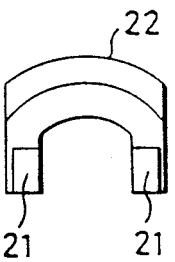
FIG. 7 shows a view of the pushing member seen along an arrow F shown in FIG. 5.
Figure 5:
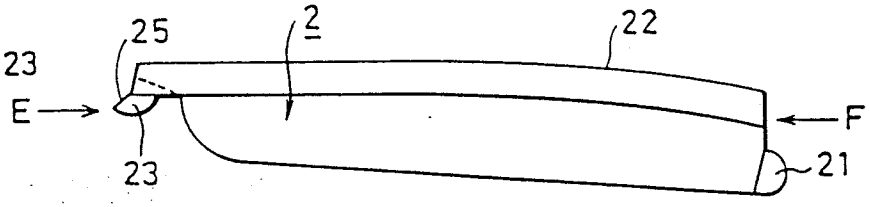
FIG. 5 shows a side view of the pushing member.
Figure 6:
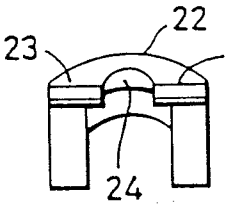
FIG. 6 shows a view of the pushing member seen along an arrow E shown in FIG. 5.

As shown in FIGS. 1, 4, 5, 6 and 7, the side pushing member 2 extends along the axial direction of the outer cylinder 1, and comprises the manipulating projection 22, which is pushed by the fingertip, lever pushing portions 23 provided at the lower end of the member, and the turning portions 21 provided at the upper end of the member. As shown in FIGS. 4 and 6, the lever pushing portions 23 are located at both the sides of a central notch 24, respectively, to secure a passage for a lead S in the notch. Bent portions 25 are provided at the lower ends of the lever pushing portions 23 so that when the side pushing member 2 is not pressed, the bent portions are located in contact with the wall of the middle cylinder 1B under the side pushing hole 101B thereof, as shown by a full line in FIG. 1, to prevent the side pushing member from springing out from the middle cylinder.

Figure 9:
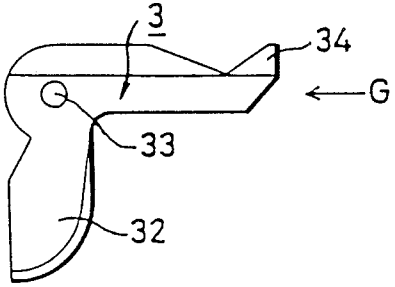
FIG. 9 shows a side view of the lever.
Figure 8:
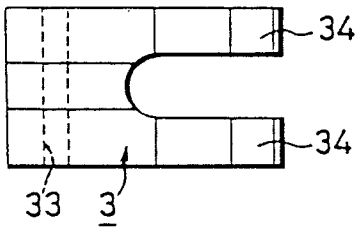
FIG. 8 shows a plan view of the lever of the mechanical pencil.
Figure 10:
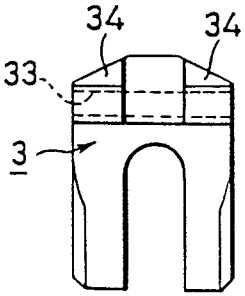
FIG. 10 shows a view of the lever seen along an arrow G shown in FIG. 9.

The lever 3 is pushed by the side pushing member 2 so that the lever is turned about the lever support shaft 31 as shown by an arrow in FIG. 1, to push and move an outer sleeve 4 downward. As shown in FIGS. 8, 9 and 10, the lever 3 comprises an outer sleeve pushing portion 32 provided at the lower end of the lever, a through hole 33 in which the lever support shaft 31 is fitted, and engaging portions 32 engaged with the lever pushing portions 23 of the side pushing member 2.

Figure 11:
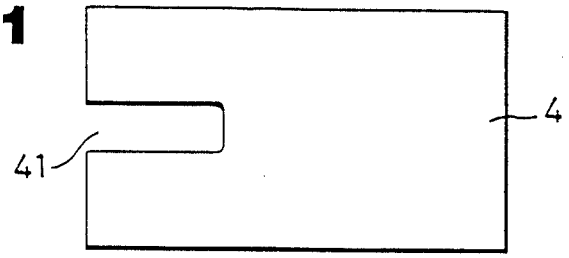
FIG. 11 shows a plan view of the outer sleeve of the mechanical pencil.
Figure 12:
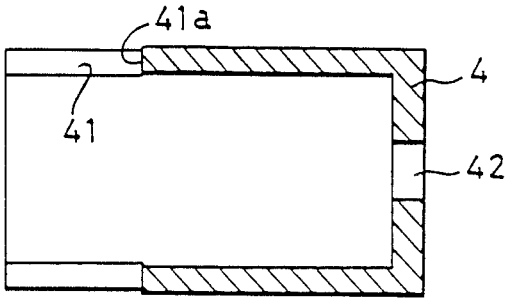
FIG. 12 shows a longitudinally sectional view of the outer sleeve.

As shown in FIG. 1, the outer sleeve 4, which is pushed by the lever 3, is always urged upward by a first and a second resilient members 17 and 18 to keep the lever and the side pushing member 2 in positions shown by full lines in FIG. 1, and to return them to the positions when the side pushing member is pressed to move down the lead S. As shown in FIGS. 11 and 12, the outer sleeve 4 is cylindrically shaped, and has stopper engaging slits 41 extending by a prescribed length from the lower end of the sleeve along the axial direction thereof, and a lead passage hole 42 provided in the rear portion of the sleeve. The facets 41*a* of the sleeve 4, which are located over the stopper engaging slits 41, act to push stopper projections 191 downward. A stopper 19 and an inner sleeve 5 are provided in the outer sleeve 4 so that the stopper and the inner sleeve are slidable in the axial direction of the outer sleeve.

Figure 13:
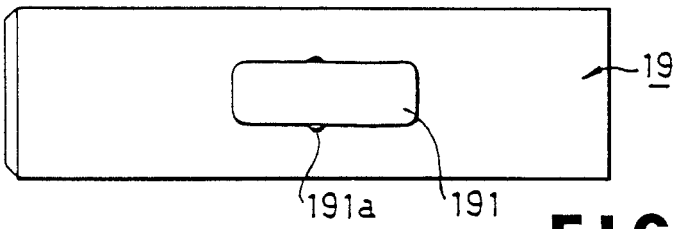
FIG. 13 shows a plan view of the stopper of the mechanical pencil.
Figure 14:
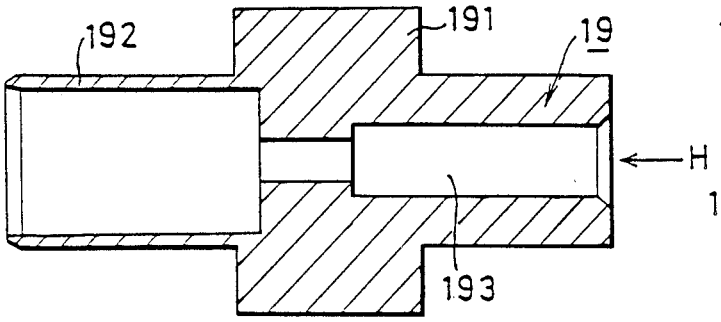
FIG. 14 shows a longitudinally sectional view of the stopper.
Figure 15:
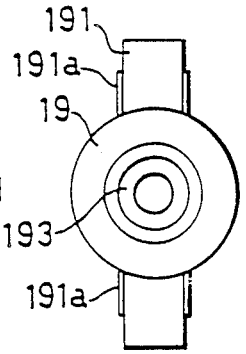
FIG. 15 shows a view of the stopper seen along an arrow H shown in FIG. 14.

The stopper 19 acts to push and move a lead chuck 61 downward when the lead S is moved out. As shown in FIGS. 13, 14 and 15, the stopper 19 comprises a lead chuck pushing cylinder 192, a lead passage hole 193 extending in the central portion of the stopper in the axial direction thereof, the stopper projections 191 engaged with the outer sleeve 4 and the inner sleeve 5, and friction juts 191*a* provided on the sides of the stopper projections to apply a prescribed frictional force to the inner sleeve at the frictional slide slits 51 thereof. As shown in FIG. 1, there is a distance a between the lower end of the lead chuck pushing cylinder 192 of the stopper 19 and the posterior step 65*a* of the lead chuck 61.

Figure 18:
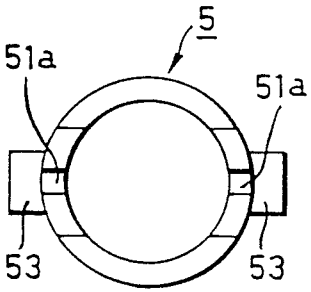
FIG. 18 shows a view of the inner sleeve seen along an arrow I shown in FIG. 16.
Figure 16:
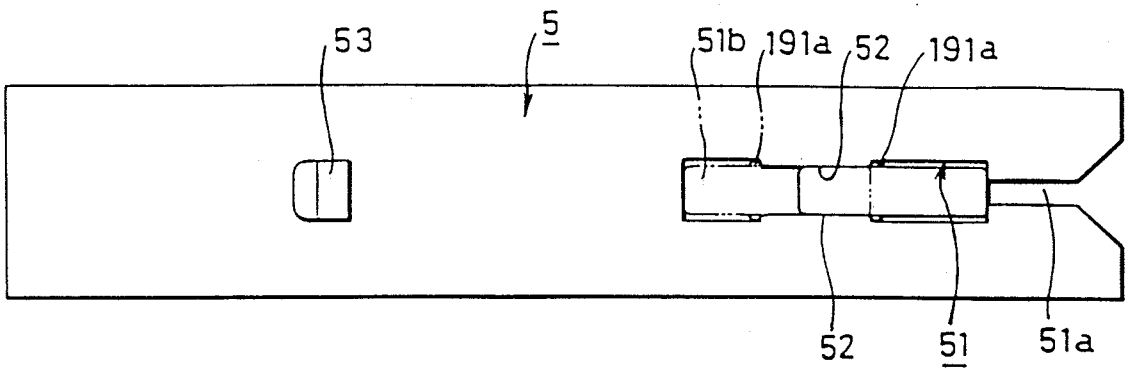
FIG. 16 shows a plan view of the inner sleeve of the mechanical pencil.
Figure 17:
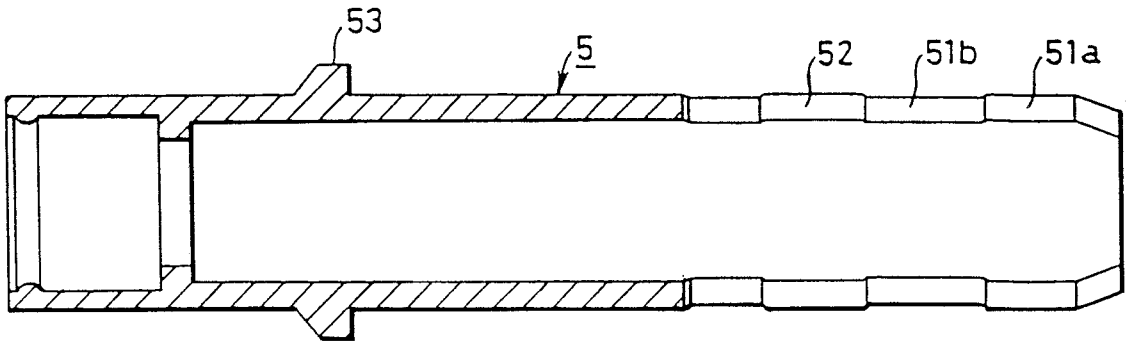
FIG. 17 shows a longitudinally sectional view of the inner sleeve.

The inner sleeve 5 is slidably fitted in the outer cylinder 1. As shown in FIGS. 1, 16, 17 and 18, the inner sleeve 5 is cylindrically shaped and has the pair of friction slide slits 51 which have the same form as each other and allow the inner sleeve to slide while receiving the prescribed frictional force from the friction juts 191*a* of the stopper projections 191. As shown in FIGS. 16, 17 and 18, the friction slide slits 51 comprise guide slits 51*a* for guiding the stopper projections of the stopper 19, and slide slits 51*b* communicating with the guide slits. Friction juts 52 are provided at the middle portions of the slide slits 51*b* to apply frictional forces to the friction juts 191*a* of the stopper projections 191 of the stopper to move down the inner sleeve 5 as a whole by a prescribed length together with the stopper 19 and the outer sleeve 4 to move out the lead S. As shown in FIG. 1, an unlocking ring 8 is fitted in a body ring 7 at the lower end of the inner sleeve 5, a lead move-out mechanism 6 is provided in the inner sleeve, and the peripheral portion of the sleeve is provided with a backward movement restricting projection 53, which is engaged with the inside step 52 of the lower cylinder 1A to restrict the backward movement of the inner sleeve. There is a distance b between the lower end of the body ring 7 and the inside step 101*d* of the tip member 1D. The distance b is equal to the moved length of the lead S at the time of side pushing described hereinafter.

The second resilient member 18 is resiliently fitted between the unlocking ring 8 and a slider 9 slidably fitted in the lower portion of the tip member 1D, and urges the unlocking ring upward and the slider downward. There is a distance c between the inside step 7*a* of the lower portion of the body ring 7 and the engaging projection 91 of the slider 9. The distance c is equal to the range in which the slider 9 can be moved up at the time of automatic writing described hereinafter. For these reasons, the inside step 7*a* of the lower portion of the body ring 7 acts to restrict the upward movement of the slider 9 at the time of the automatic writing. Since the upper end of the unlocking ring 8 comes into contact with the inside step 71 of the upper portion of the body ring 7, the upward movement of the unlocking ring is restricted. The inner sleeve 5 is thus urged upward by the second resilient member 18 through the actions of the body ring 7 and the unlocking ring 8.

The body ring 7 has a function of retaining the unlocking ring 8 movably in the body ring, a function of restricting the upward movement of the unlocking ring by the lower end of the inside step 71 of the upper portion of the body ring, a function of preventing the coming-off of balls 63 by the upper end of the inside step 71, and a function of locking the slider 9 in a completely housed position in the tip member 1D. The outside circumferential surface of the upper outer cylindrical portion of the slider 9 is provided with the engaging projection 91 as a means for locking the slider and the body ring 7 to each other. The inside circumferential surface of the lower portion of the body ring 7 is provided with an engaging recess 72 as another means for locking the slider 9 and the body ring 7 to each other. When the engaging projection 91 of the slider 9 moved up is engaged in the engaging recess 72 of the body ring 7, the slider is locked in the completely housed position in the tip member 1D. At the time of the side pushing described hereinafter, the unlocking ring 8 is moved down to push and move the upper end of the slider down from the completely housed position to unlock the slider from the body ring 7.

The slider 9 has an inner cylindrical portion 92 which can be elastically deformed in the radial direction of the slider and acts to apply a prescribed frictional force to the lead S. The frictional force allows the lead S to be moved down but hinders it from being moved up.

The upper cylinder 1C of the outer cylinder 1 comprises a lead housing portion 12 in which a plurality of leads S can be housed, and an eraser housing portion 14 provided at the upper end of the lead housing portion. An eraser 15 is supported in the eraser housing portion 14. A cap 16 for covering the eraser 15 is removably fitted on the upper end of the upper cylinder 1C.

FIG. 1 shows a longitudinally sectional view of one half part [indicated at (i) in FIG. 1] of the slider 9 being at the time of writing or the like, and shows a longitudinally sectional view of the other half part [indicated at (ii) in FIG. 1] of the slider being at the time of the locking described further hereinafter.

The lead move-out mechanism 6 provided in the inner sleeve 5 comprises the lead chuck 61 divided into two parts along the axis thereof, the balls 63 retained by the ball retaining lower portion 62 of the lead chuck, a metal cylinder 64 which is fitted in the lower portion of the inner sleeve 5 if necessary and has an inside tapered surface 64*a* between which and the ball retaining portion 62 the balls are fitted to be retained, and a third resilient member 66 resiliently fitted between the inside step of the inner sleeve 5 and the lower facet 65*b* of the engaging projection 65 of the lead chuck 61. The lead move-out mechanism 6 allows the lead S to be moved down but hinders it from being moved up. The mechanism 6 is further described as a lead chuck of a mechanical pencil having chuck members divided into a plurality of sections with a lead inserting hole at its core part; a ball holding part for use in holding balls formed at outer peripheral portions of the chuck members; lead supporting portions formed at inner circumferential surfaces of extremity ends of said chuck members and for supporting a plurality of leads; and lead residue discharging portions formed near the lead supporting portions. Lead chuck 6 is further characterized in that the lead supporting portions support the lead at four points, and in that inner circumferential surfaces of the extremity end portions of the lead chuck members are formed with lead biting teeth and four point lead supporting portions are formed by said teeth.

The urging force X of the second resilient member 18, the frictional force Y of the inner cylindrical portion 92 of the slider 9 to the lead S and the lead pinching force Z of the lead chuck 61 are related to each other as $X>Z$ and $Y>Z$ in order to pull out the lead S down from the lead chuck by the downward movement of the slider at the time of the automatic writing or the side pushing.

The assembly of the mechanical pencil is now described. The lead move-out mechanism 6 is first built in the inner sleeve 5. For the building, the parts of the lead chuck 61 are combined with each other, and the third resilient member 66 is loosely fitted on the peripheral surface of the lead chuck. The metal cylinder 64 is press-fitted in the lower portion of the inner sleeve 5 in advance. The lead chuck 61 loosely fitted with the third resilient member 66 is inserted into the inner sleeve 5 from the upper end thereof. The lead chuck 61 is then pushed downward so that the third resilient member 66 is compressed and the balls 63 are inserted to the ball retaining portion 62 of the lead chuck 61 from the lower end of the inner sleeve 5. After that, the pushing of the lead chuck 61 is stopped so that the balls 63 are properly set on the ball retaining portion 62. The body ring 7 is then pressfitted in the lower end of the inner sleeve 5. The unlocking ring 8 is put in the body ring 7. The lower end of the slider 9 is fitted into the body ring 7 from the lower end thereof while the second resilient member 18 interposed between the unlocking ring 8 and the slider 9 is compressed, so that the engaging projection 91 of the slider is engaged in the engaging recess 72 of the body ring 7. As a result, the inner sleeve 5, the lead move-out mechanism 6, the body ring 7, the unlocking ring 8, the second resilient member 18 and the slider 9 are coupled together. The first resilient member 17 is then fitted onto the peripheral surface of the inner sleeve 5 downward. The stopper 19 is pushed into the friction slide slits 51 of the inner sleeve 5. The outer sleeve 4 is fitted on the stopper 19 so that the outer sleeve is engaged with the stopper projections 191. As a result, the stopper 19 and the outer sleeve 4 are coupled to the inner sleeve 5. After that, the lower cylinder 1A, the middle cylinder 1B fitted with the pushing member 2 and the lever 3 and the upper cylinder 1C are screwed to each other. The mechanical pencil is thus assembled.

Since the inner sleeve 5, the stopper 19 and the outer sleeve 4 are urged upward by the first and the second resilient members 17 and 18 after the completion of the assembly of the mechanical pencil as shown in FIG. 1, the pushing member 2 and the lever 3 are in positions shown by full lines in FIG. 1, so that the manipulating projection 22 of the pushing member is exposed in the side pushing hole 102B of the middle cylinder 1B to enable the side pushing.

Figure 19:
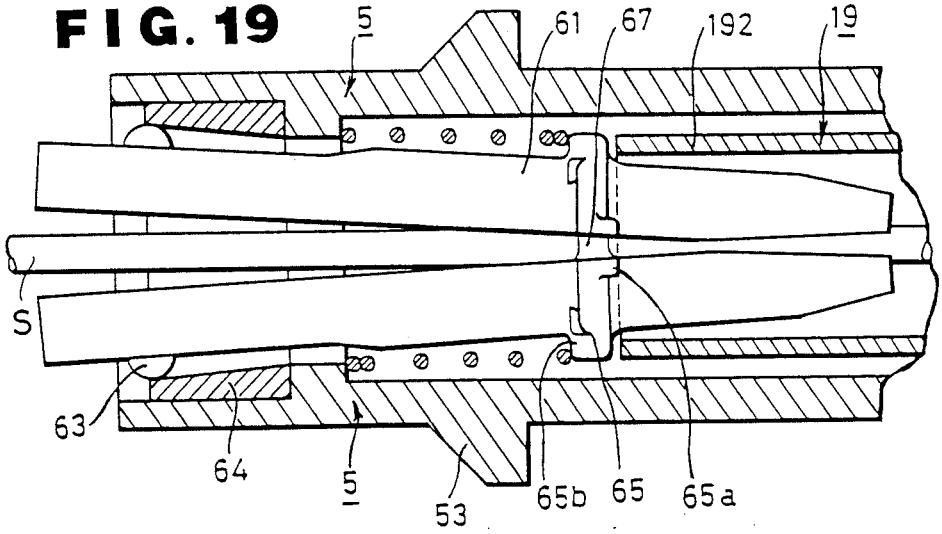
FIG. 19 shows a view for describing the opening of the lead chuck of the mechanical pencil.

The mechanical pencil can perform two kinds of lead move-out operation, one of which is described from now on. In this kind of operation, the lead S is moved out by the side pushing as the outer cylinder 1 of the mechanical pencil is held for writing. When the lead S is worn in the writing as the slider 9 is held in the position shown for the half part thereof (which is the upper half portion as to FIG. 1) in FIG. 1, the manipulating projection 22 of the pushing member 2 is pushed against the forces of the first and the second resilient members 17 and 18 by the index finger of the hand holding the mechanical pencil, without re-holding the outer cylinder 1, for example. Because of this side pushing, the lever 3 is turned as shown by the arrow in FIG. 1, so that the outer sleeve 4 and the stopper 19 are pushed and moved down. At that time, since the friction juts 191*a* of the stopper projections 191 are engaged in the friction slits 51 of the inner sleeve 5 by the prescribed frictional force, the inner sleeve, the lead move-out mechanism 6, the body ring 7 and the unlocking ring 8 are moved down together until the lower end of the body ring comes into contact with the inside step 101*d* of the tip member 1D. In other words, they are moved down together by the distance b between the body ring 7 and the inside step 101*d*. For that reason, the distance b is equal to the moved length of the lead S in the operation. Since the outer sleeve 4 and the stopper 19 are pushed downward further by the lever 3, a force stronger than the prescribed frictional force having acted to the friction juts 191*a* of the stopper projections 191 and the friction slits 51 of the inner sleeve 5 acts thereto so that only the stopper and the outer sleeve are moved down to push the upper projections 65*a* of the lead chuck 61 by the lower end of the lead chuck pushing cylinder 192 of the stopper. As a result, the lead chuck 61 is pushed forward against the urging force of the third resilient member 66 engaged on the lower facet 65*b* of the lead chuck. In this process of move-down, pushing forces reverse to each other in direction act to the lower facet 65b and the upper projections 65a so that the lead chuck 6 is opened by leverage about engaging projections 67 as fulcra as shown in FIG. 19, to release the lead S. The operation is repeatedly performed to move out the lead S in a normal manner.

When the side pushing of the manipulating projection 22 of the pushing member 22 is ceased, the outer and the inner sleeves 4 and 5 coupled to each other are moved up by the urging forces of the first and the second resilient members 17 and 18. At that time, since the lead S is pinched by the friction-causing inner cylinder 92 of the slider 9 and the third resilient member 66 receives a compressive force so that the pinching of the lead by the lead chuck 61 is ceased. As a result, the outer and the inner sleeves 4 and 5 coupled to each other are moved up as the lead S is left pinched by the inner cylinder 92 of the slider 9. For that reason, the lead S moved out from the lower end of the slider 9 by the side pushing remains not affected by the upward movement of the sleeves 4 and 5.

The other kind of lead move-out operation, which is to automatically move out the lead S in response to the stoppage of the writing, is now described. Normally, the writing is performed as the lead S remains protruded by a prescribed length from the lower end of the slider 9. When the lead S is worn along with the progress of the writing, the lower ends of the lead and the slider 9 become flush with each other. In that state, the slider 9 can still be moved up by the distance c (shown in FIG. 1) against the urging force of the second resilient member 18. It takes a very long time of writing to wear the lead S by the writing to move up the slider 9 by the distance c. For example, the lead S is worn by only about 0.01 mm when the lead is HB in hardness and 0.5 mm in diameter and a chinese character is written under ordinary pressure by an ordinary adult with the mechanical pencil having the lead. For that reason, it is usually unlikely to continuously perform the writing with the mechanical pencil until the slider 9 is moved up by the distance c, but it is very likely to stop the writing with the pencil for a while.

The length of the projection of the slider 9 from the lower end of the tip member 1D may be set to be smaller than the distance c.

It is then supposed that the writing is stopped and the lower end of the slider 9 is moved away from the surface of paper or the like after the slider is moved up by the distance c under the pressure of the writing. As a result, the slider 9 is moved down by the resilient force of the second resilient member 18 and the lead S is pulled by the prescribed frictional force of the friction-causing inner cylinder 92 of the slider. Since the lead S is pinched by the lead chuck 61, the chuck is moved down together with the lead. However, the moved-down length of the lead chuck is very small, and the chuck stops the pinching of the lead S after the moving-down of the chuck. In other words, the balls 63 on the lower portion of the lead chuck 61 are in rolling contact with the inside tapered surface 64a of the metal cylinder 64 at the time of the moving-down of the lead chuck so that the lead pinching force of the chuck weakens along with the moving-down thereof to make it possible to move out the lead S. As a result, the mechanical pencil is returned to a state shown in FIG. 1 [the slider 9 is in the position shown therein for the upper half portion thereof (as to FIG. 1)]. The lead S is thus automatically moved out so that writing can be performed again with the mechanical pencil, continuously up to the moved-up length c of the slider 9.

Locking the slider 9 in a housed position is now described. When the slider 9 is in an ordinary writing state shown for the upper half portion (i) thereof in FIG. 1, the lower end of the slider 9 is pushed on the surface of paper or the like and the manipulating projection 22 of the pushing member 2 is subjected to side pushing by a fingertip. As a result, the slider 9 is moved up against the resilient force of the second resilient force 18, the outer and the inner sleeves 4 and 5 and the stopper 19 are moved down, the body ring 7 comes into contact with the inside step 101d of the tip member D, and the lead S is released from the lead move-out mechanism 6, so that the engaging projection 91 of the slider 9 is engaged in the engaging recess 72 of the body ring. When the fingertip is separated from the manipulating projection 22 of the pushing member 2, the outer and the inner sleeves 4 and 5 and the stopper 19 are moved up by the resilient forces of the first and the second resilient forces 17 and 18 so that the slider 9 is housed in the outer cylinder 1. The slider 9 is thus locked in a completely housed position in the tip member 1D. The way of unlocking the slider 9 is the same as that described above.

Although a side pushing mechanism is applied to the automatic mechanical pencil which is the above-described embodiment, the present invention is not confined to the application but may be applied to an unautomatic mechanical pencil in such a manner that a lead tube is pressed by a lever 3 under side pushing, for example, instead of pushing the tube at the top thereof.

What is claimed is:

1. A mechanical pencil comprising:

an outer cylinder having upper and lower ends and including means for housing a plurality of leads;

an outer sleeve disposed within said outer cylinder;

lead move-out means, disposed within said outer cylinder and in contact with said outer sleeve, for feeding one of said plurality of leads out through said lower end of said outer cylinder upon downward movement of said outer sleeve;

a side pushing hole formed in a side of said outer cylinder;

a pushing member positioned within said side pushing hole and having upper and lower ends, said lower end of said pushing member being slidable in said side pushing hole between first and second positions, said upper end of said pushing member including a pivot point about which said pushing member pivots when said lower end of said pushing member is moved between said first position and said second position; and lever means, pivotally mounted within said outer cylinder and in contact with said lower end of said pushing member and with said outer sleeve, for pressing said outer sleeve downwardly upon movement of said lower end of said pushing member from said first position to said second position, said lever means including a first leg which contacts said lower end of said pushing member and a second leg which contacts said outer sleeve, said second leg being bifurcated so as to form a passage through which leads can pass, wherein said pushing member and said lever means are disposed longitudinally between said lead move-out means and said lead housing means and are adapted to cooperate with each other for changing movement of said pushing member into movement of said outer sleeve.

2. A mechanical pencil adapted to contain a plurality of leads, comprising:

an outer cylinder having upper and lower ends, said lower end having an opening therein through which one of said plurality of leads can protrude and have an upwardly directed writing pressure induced thereagainst;

automatic lead feeding means, connected within said outer cylinder, for feeding lead forwardly when said writing pressure is released from against said one of said plurality of leads; and manual lead feeding means comprising:

lead advance means including an upper portion for feeding said one of said plurality of leads downwardly upon downward movement of said upper portion, a lever pivotally mounted about an axis in said outer cylinder and having upper and lower legs, said lower leg being in contact with said upper portion of said lead advance means, and a push button, disposed in contact with said upper leg of said lever and within a side push hole formed in a side of said outer cylinder, and in contact with said upper leg of said lever, such that radially inward movement of said push button forces said lever to pivot about said axis and press downwardly against said upper portion of said lead advance means, said manual lead feeding means, connected within said outer cylinder, for feeding said one of said plurality of leads downwardly through said opening in said lower end of said outer cylinder upon manual exertion of a force directed radially inwardly of said outer cylinder.

3. A mechanical pencil adapted to contain a plurality of leads, comprising:

an outer cylinder having upper and lower ends, said lower end having an opening therein through which one of said plurality of leads can protrude;

a slider slidably disposed in said opening in said lower end of said outer cylinder and adapted to apply a prescribed frictional force about the circumference of said one of said plurality of leads;

a body ring axially slidably disposed in said outer cylinder and having an upper end and a lower end, said lower end of said body ring having a slider engaging portion for engagement with an upper end of said slider;

an inner sleeve axially slidably disposed in said outer cylinder and having an upper and a lower end, said lower end of said inner sleeve being secured to said upper end of said body ring;

a stopper frictionally and slidably engaged with an upper end of said inner sleeve; and a lead move-out means, slidably disposed within said inner sleeve, for causing said one of said plurality of leads to be fed downwardly and for hindering upward movement of said one of said plurality of leads;

a first resilient means disposed within said outer cylinder for urging said inner sleeve upwardly;

a second resilient means disposed within said outer cylinder for urging said slider downwardly;

a lever means, pivotally mounted in said outer cylinder, for forcing said stopper, and thus said inner sleeve, downward upon pivoting of said lever means;

a side hole formed in a side of said outer cylinder; and a side push button means, radially movably disposed in said side hole, for contacting and causing pivoting of said lever means.

4. A mechanical pencil as recited in claim 5, wherein a lower portion of said stopper engages with an upper portion of said lead move-out means.

* * * * *